US010385738B2

(12) United States Patent
Rieger et al.

(10) Patent No.: US 10,385,738 B2
(45) Date of Patent: Aug. 20, 2019

(54) VARIABLE VALVE CONTROL DEVICE FOR INTERNAL COMBUSTION ENGINES

(71) Applicant: AVL LIST GMBH, Graz (AT)

(72) Inventors: Johannes Rieger, Semriach (AT); Thomas Moser, Judendorf-Strassengel (AT); Benjamin Bierbaumer, Lannach (AT)

(73) Assignee: AVL LIST GMBH, Graz (AT)

( * ) Notice: Subject to any disclaimer, the term of this patent is extended or adjusted under 35 U.S.C. 154(b) by 0 days.

(21) Appl. No.: 15/760,091

(22) PCT Filed: Sep. 19, 2016

(86) PCT No.: PCT/AT2016/060065
§ 371 (c)(1),
(2) Date: Mar. 14, 2018

(87) PCT Pub. No.: WO2017/045008
PCT Pub. Date: Mar. 23, 2017

(65) Prior Publication Data

US 2018/0266280 A1 Sep. 20, 2018

(30) Foreign Application Priority Data

Sep. 18, 2015 (AT) ..... 50802/2015

(51) Int. Cl.
*F01L 1/047* (2006.01)
*F01L 13/00* (2006.01)

(52) U.S. Cl.
CPC ..... *F01L 1/047* (2013.01); *F01L 13/0036* (2013.01); *F01L 2001/0473* (2013.01); *F01L 2013/0052* (2013.01)

(58) Field of Classification Search
CPC ..... F01L 2001/0473; F01L 1/053; F01L 1/46; F01L 13/0036; F01L 2013/0052; F01L 2105/00
(Continued)

(56) References Cited

FOREIGN PATENT DOCUMENTS

DE 102007010157 6/2008
DE 102007010156 9/2008
(Continued)

OTHER PUBLICATIONS

English Abstract of DE102011076726.
(Continued)

*Primary Examiner* — Jorge L Leon, Jr.
(74) *Attorney, Agent, or Firm* — Dykema Gossett PLLC

(57) ABSTRACT

The invention relates to a variable valve control device (1) for internal combustion engines of the reciprocating-piston design having at least one gas exchange valve (32), which can be actuated by a camshaft (3) by means of a cam device (4) that is connected to the camshaft (3) for conjoint rotation and that has at least two different cam tracks (7, 8), which camshaft is supported in such a way that the camshaft can be rotated about a camshaft axis (2), wherein, selectively, one of the cam tracks (7, 8) can be activated and at least one other cam track (8, 7) can be deactivated by means of a control device (10), and wherein the control device (10) has at least one control lever (12), which can be pivoted about a pivot axis (11), and has at least one first control body (13), which is connected to the camshaft (3) for conjoint rotation and in the surface of which at least one first control groove (17) and at least one second control groove (18) are formed, wherein, selectively, a first control stud (19) of the control lever (12) can be directed into the first control groove (17) or a second control stud (20) of the control lever (12) can be directed into the second control groove (18). In order to
(Continued)

enable a compact variable valve control system having little production and construction complexity, the control body (13) has an inner first lateral surface (14) and an outer second lateral surface (15), wherein the first lateral surface (14) has a smaller distance from the camshaft axis (2) than the second lateral surface (15) has and the two lateral surfaces (14, 15) are arranged concentric to the camshaft axis (2), and wherein the two lateral surfaces (14, 15) facing each other bound a substantially annular control space (16), and the first control groove (17) is formed in the first lateral surface (14) and the second control groove (18) is formed in the second lateral surface (15).

17 Claims, 5 Drawing Sheets

(58) Field of Classification Search
USPC ..... 123/90.18, 90.2, 90.27
See application file for complete search history.

(56) References Cited

FOREIGN PATENT DOCUMENTS

| | | |
|---|---|---|
| DE | 102008060169 | 6/2010 |
| DE | 102011076726 | 12/2012 |
| DE | 102011085705 | 5/2013 |
| WO | 2013060405 | 5/2013 |

OTHER PUBLICATIONS

English Abstract of DE102011085705.
English Abstract of DE102008060169.
English Abstract of DE102007010157.
English Abstract of DE102007010156.

VARIABLE VALVE CONTROL DEVICE FOR INTERNAL COMBUSTION ENGINES

The invention relates to a variable valve control device for internal combustion engines of the reciprocating piston design comprising at least one gas exchange valve, which is actuable by means of a camshaft, which is rotatably mounted about a rotational axis, via a cam device, which is connected in a rotationally-fixed manner to the camshaft and has at least two different cam tracks, wherein alternately one of the cam tracks is activatable and at least one other cam track is deactivatable by means of the control device, and wherein the control device has at least one control lever pivotable about a pivot axis and at least one first control body connected in a rotationally-fixed manner to the camshaft, in the surface of which at least one first control groove and at least one second control groove are formed, wherein alternately a first control stud of the control lever can be guided into the first control groove or a second control stud of the control levers can be guided into the second control groove.

A valve drive of an internal combustion engine having a camshaft is known from DE 10 2011 076 726 A1, which has a carrier shaft and also a carrier hub, which is arranged thereon so it is rotationally-fixed and axially displaceable between two positions. The carrier hub has a cam body having two axially adjacent cams, the cam tracks of which have different cam protrusions and identical base circle diameter. A cylindrical control body has at least one first and one second helical control groove, in each of which a housing-side mounted control stud of an actuating device can be engaged for axial adjustment of the carrier hub. The actuating device has a tilt lever, which is arranged with axial alignment radially adjacent to the control body and is mounted so it is pivotable about a tangential axis. The tilt lever has a control pin at each of the two ends and is pivotable by an actuating element in a formfitting and/or friction-locked manner into a first position, in which the control pin engages with the assigned control groove. Furthermore, the tilt lever is pivotable into a second position, in which the control stud is disengaged from the associated control groove. At the same time, a second control pin arranged at the other end of the tilt lever engages in an associated second control groove in this second position. It is disadvantageous that a large amount of structural space is occupied, such that this arrangement is not suitable for many applications.

A further valve drive for an internal combustion engine comprising a camshaft is known from DE 10 2011 117 244 A1. The camshaft has a carrier shaft comprising at least one rotationally-fixed and axially-displaceable cam part, which is displaceable by a switching element from a first axial end position into a second axial end position and can be held by a regulating element in this end position. The part has a switching slotted guide having a groove in this case, into which an actuating element extends and follows the switching contour of the groove. The cam part can be held in an end position by a locking element. The regulating element is unlocked for the axial displacement of the cam part and is locked in the region of the assumed end position. The switching element is coupled to the locking element via rockers. This valve drive also occupies a relatively large amount of space and additionally has many individual parts, which increases the production expenditure.

The object of the invention is to avoid the mentioned disadvantages and to enable compact variable valve control with low production and construction expenditure.

This is achieved according to the invention in that the control body has an inner first lateral surface and an outer second lateral surface, wherein the first lateral surface has a smaller distance from the camshaft axis than the second lateral surface and the two lateral surfaces are arranged concentrically to the camshaft axis, and wherein the two lateral surfaces facing toward one another delimit an essentially ring-shaped control chamber, and the first control groove is formed into the first lateral surface and the second control groove is formed into the second lateral surface.

The first and second control grooves are therefore arranged in the radial direction one on top of another in the same axial section of the camshaft, wherein the first and second control grooves are arranged opposite and facing toward one another in relation to the control chamber. Structural space can thus be saved in the axial direction of the camshaft.

To enable simple tapping of the switching contour formed by the control groove by means of the control lever, the essentially cylindrical control chamber is advantageously embodied as open on a first end face preferably facing toward the cam device, wherein the control lever is arranged protruding through the open end face into the control chamber.

To enable simple manufacturing, it is advantageous if the second lateral surface is arranged on the inner side of a sleeve part, which is fixedly connected to the camshaft, preferably pressed on, wherein particularly preferably the connection between camshaft and sleeve part is produced at a second end face of the control chamber facing away from the cam device.

The valve control device occupies very little structural space if the pivot axis of the control lever is arranged parallel to the camshaft axis. Alternatively thereto, it can be provided that the pivot axis of the control lever is arranged inclined to the camshaft axis, wherein, in at least one projection normal on the camshaft axis, the pivot axis encloses an angle with the camshaft axis between 0° and 60°, preferably between 0° and 30°. This embodiment can offer design advantages in particular in the case of structural constraints of OHC valve controllers.

In a first preferred embodiment variant of the invention, it is provided that the control lever has a preferably forked switching element, which engages on a driver element of the cam device, which is arranged so it is axially displaceable on the camshaft. In this case, the driver element is preferably formed by a ring axially spaced apart from the cam tracks, which is preferably arranged at an end of the cam device facing toward the control body. The driver element formed as a ring can simply be manufactured together with the camshaft and enables an axial adjustment of the cam device along the camshaft axis independently of the rotational angle of the camshaft. The cam device can act on at least one gas exchange valve via tilt levers or bucket tappets.

According to a second preferred embodiment variant of the invention, it is provided that the control lever has a preferably forked switching element, which engages on a transmission element, which is non-displaceably connected to the camshaft and is actuated by the cam device, and which transmission element is formed so it is displaceable parallel to the camshaft axis. The transmission element is advantageously a roller body which is rotatable and axially displaceable on a valve lever. The cam device can be integrally formed with the camshaft in this case, and the cam tracks can be formed directly into the camshaft.

It is advantageous if the cam device or the transmission element is lockable via at least one spring latching element.

In the end positions of the cam device and/or the transmission element, axial movements within the manufacturing-related play of the elements of the control device are thus avoided, which increase the wear and can also have an acoustically disadvantageous effect.

The invention will be explained in greater detail hereafter on the basis of the nonrestrictive figures. In the figures:

Functionally identical parts are provided with identical reference signs in the embodiments.

FIGS. 1 to 4 show a first embodiment and FIGS. 5 to 10 show a second embodiment of the invention.

Figure 9:
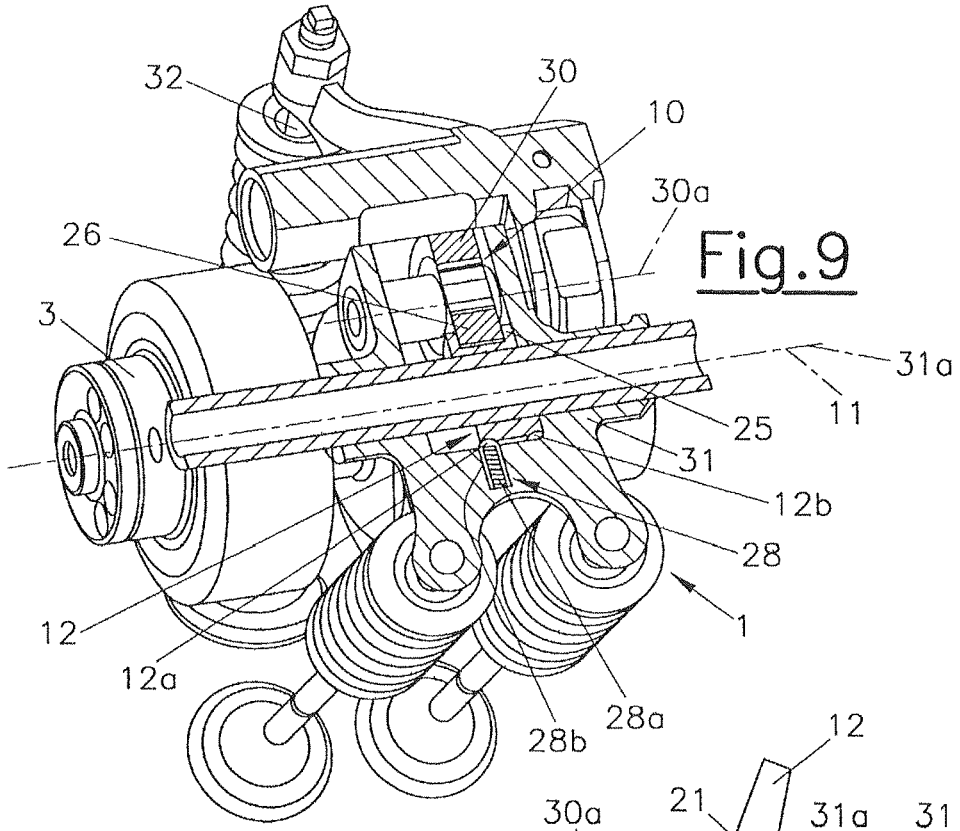
FIG. 9 shows this variable valve control device in a further diagonal view.
Figure 10:
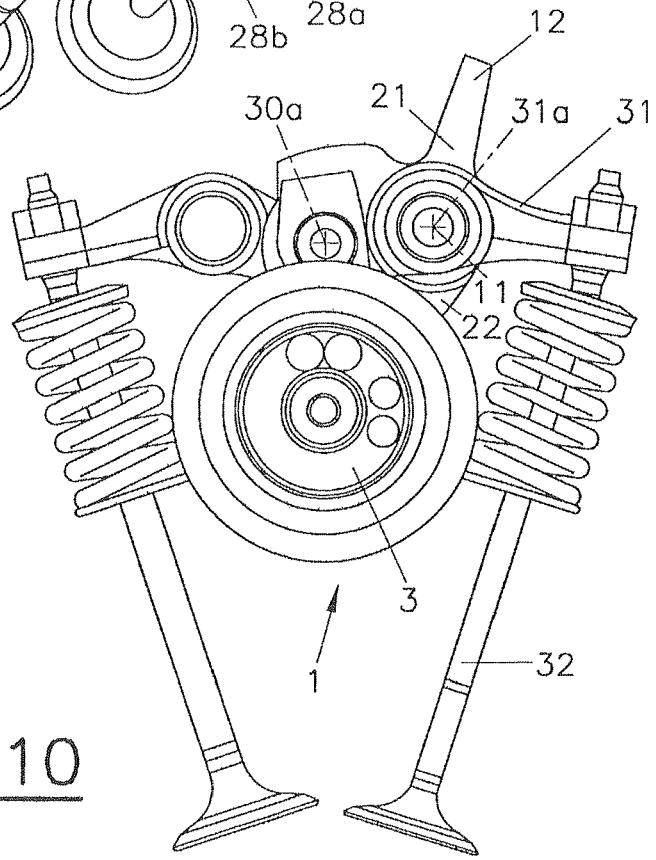
FIG. 10 shows this variable valve control device in a side view.

Both embodiment variants share the feature that the variable valve control device 1 for internal combustion engines has at least one camshaft 3 mounted so it is rotatable about a camshaft axis 2, wherein a cam device 4 having at least two cams 5, 6 and cam tracks 7, 8 is connected in a rotationally-fixed manner to the camshaft 3. The cam device 4 acts in the exemplary embodiments on a transmission element 30, which is embodied as a roller body, for example, of a transmission device 31—for example, a valve lever—which transmission device 31 actuates at least one gas exchange valve 32—shown in FIG. 9 and FIG. 10—of the internal combustion engine.

One of the cam tracks 7, 8 can alternately be activated or deactivated, respectively, via a control device 10. The control device 10 has at least one control lever 12, which is pivotable about a pivot axis 11 and is mounted so it is displaceable axially along the pivot axis 11 between two end positions, and at least one control body 13, which is connected in a rotationally-fixed manner to the camshaft 3, and which spans a control chamber 16 between a first inner lateral surface 14 and a second outer lateral surface 15. The pivot axis 11 is arranged parallel to the camshaft axis 2 in the exemplary embodiments, but can also—observed in a projection normal to the camshaft axis 2—be embodied inclined at an acute angle thereto. The essentially cylindrical lateral surfaces 14, 15 are arranged concentrically to the camshaft axis 2. The second lateral surface 15, which is oriented radially inward, is farther away from the camshaft axis 2 than the first lateral surface 14, which is oriented radially outward.

The essentially cylindrical control chamber 16 is embodied as open at a first end face **16*a* facing toward the cam device 4, wherein the control lever 12 is arranged protruding through the open end face 16*a* into the control chamber 16**.

The second lateral surface 15 is arranged in the exemplary embodiments on the inner side of a sleeve part 9, which is fixedly connected to the camshaft 3, for example, pressed on, wherein the connection between camshaft 3 and sleeve part 9 is produced at a second end face **16*b* of the control chamber 16 facing away from the cam device 4**.

A helical first control groove 17 is formed in the first lateral surface 14 and a helical second control groove 18 is formed in the second lateral surface 15, which control grooves 17, 18 form slotted guide paths. The control grooves 17, 18 are formed turning in different directions—i.e., the one control curve turns to the right, the other control curve turns to the left—into the lateral surfaces 14, 15.

The control lever 12 has a first control stud 19 and a second control stud 20, wherein the two control studs 19, 20 are arranged on the same first lever arm 21 of the control lever 12. The first and the second control studs 19, 20 are fixedly attached on the first lever arm 21 essentially radially with respect to the camshaft axis 2, but oriented differently, for example, integrally formed therewith. The first control stud 19 faces toward the first lateral surface 14 in this case and the second control stud 20 faces toward the second lateral surface 15. The first lever arm 21 of the control lever 12 is guided in the region of the open first end face **16*a* of the essentially cylindrical control chamber 16** in the interior thereof.

The control lever 12 can be pivoted via an actuator (not shown in greater detail), which engages on the second lever arm 22, between a first position and a second position, wherein the first cam track 7 is activated in the first position and the second cam track 8 is activated in the second position.

For the axial adjustment of the cam device 4 or the transmission element 30, the first control stud 19 or the second control stud 20 is pressed by switching over (black-white switching) of the control lever 12 into the opposing control groove 17, 18.

Figure 1:
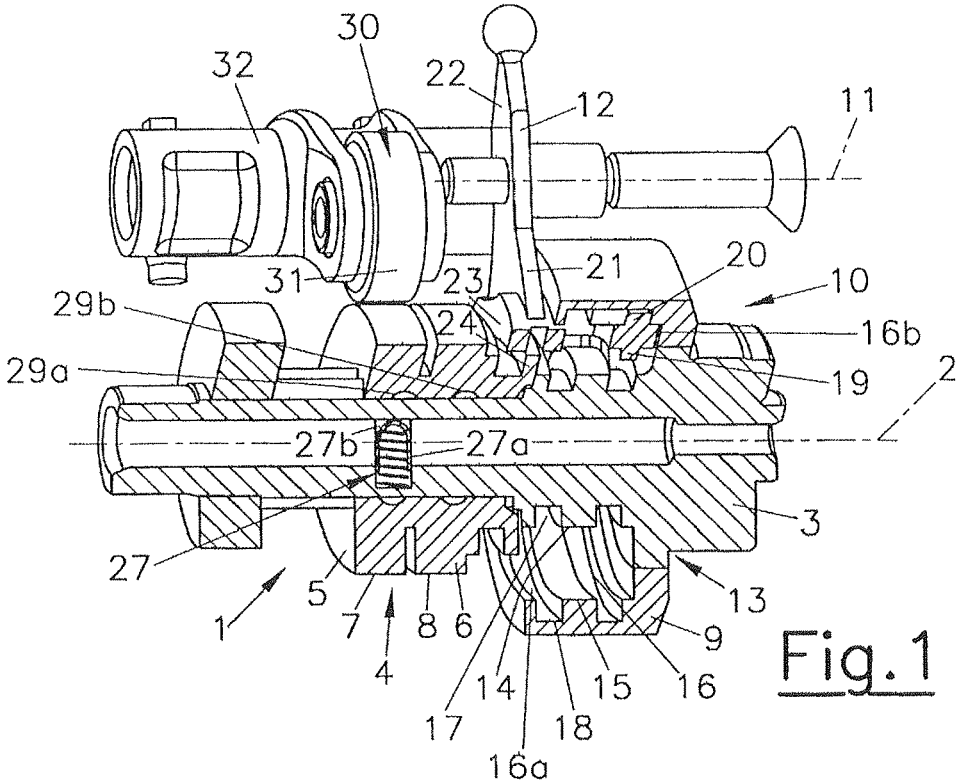
FIG. 1 shows a variable valve control device according to the invention in a first embodiment in a diagonal view in a longitudinal section in a first displacement position.
Figure 2:
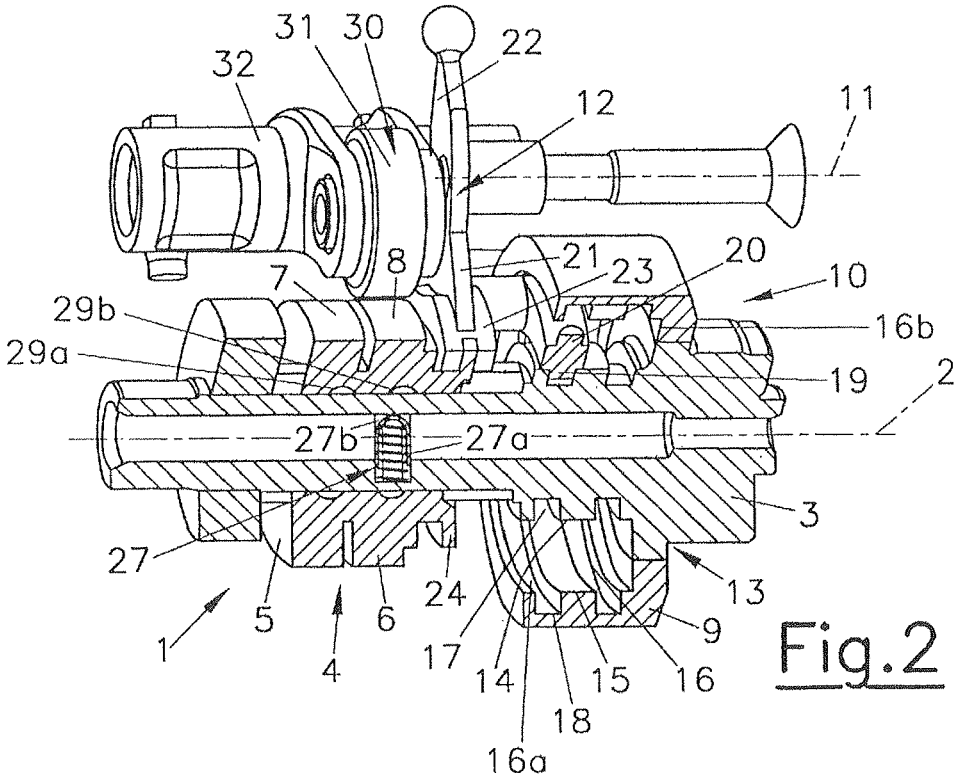
FIG. 2 shows this variable valve control device in a longitudinal section in a diagonal view in a longitudinal section in a second displacement position.
Figure 3:
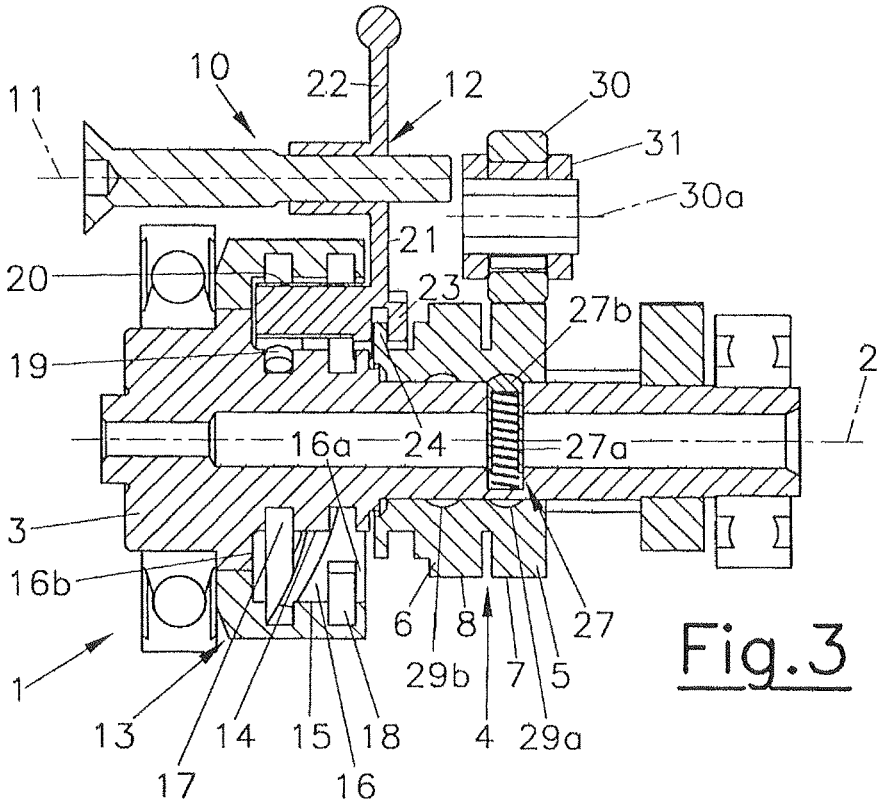
FIG. 3 shows this variable valve control device in a longitudinal section in the first displacement position.
Figure 4:
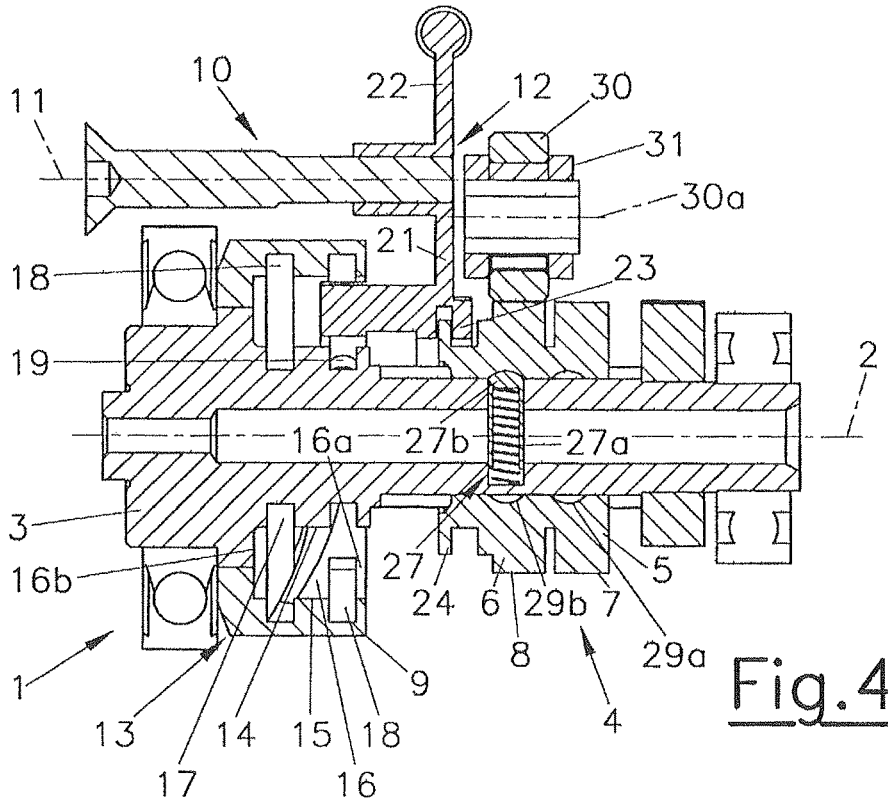
FIG. 4 shows this variable valve control device in a longitudinal section in the second displacement position.
Figure 5:
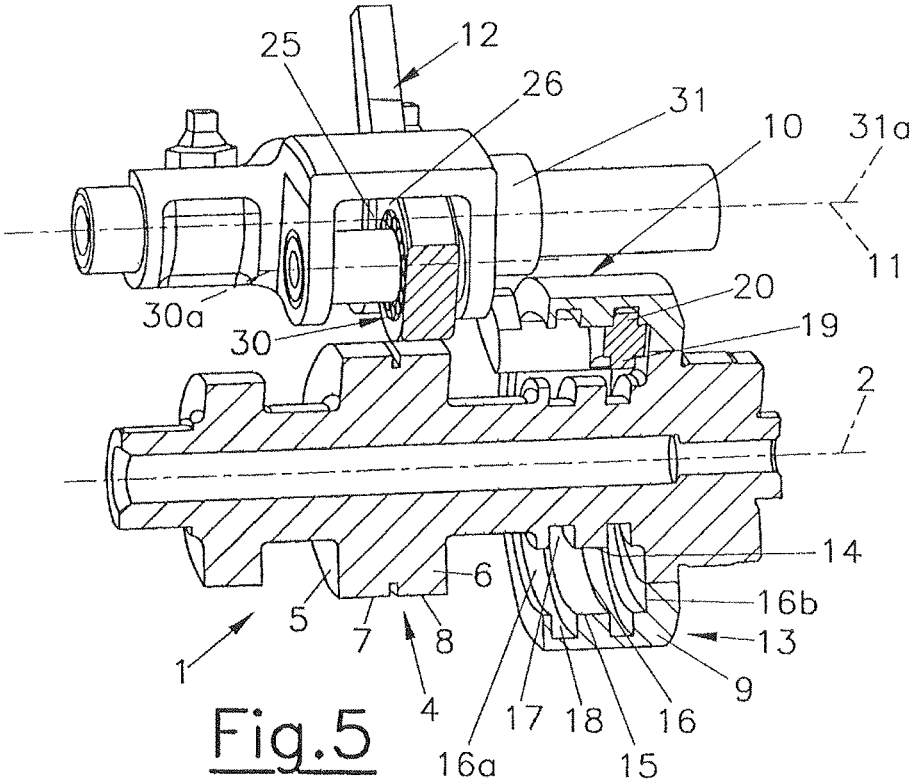
FIG. 5 shows a variable valve control device according to the invention in a second embodiment in a diagonal view in a longitudinal section in a first displacement position.
Figure 6:
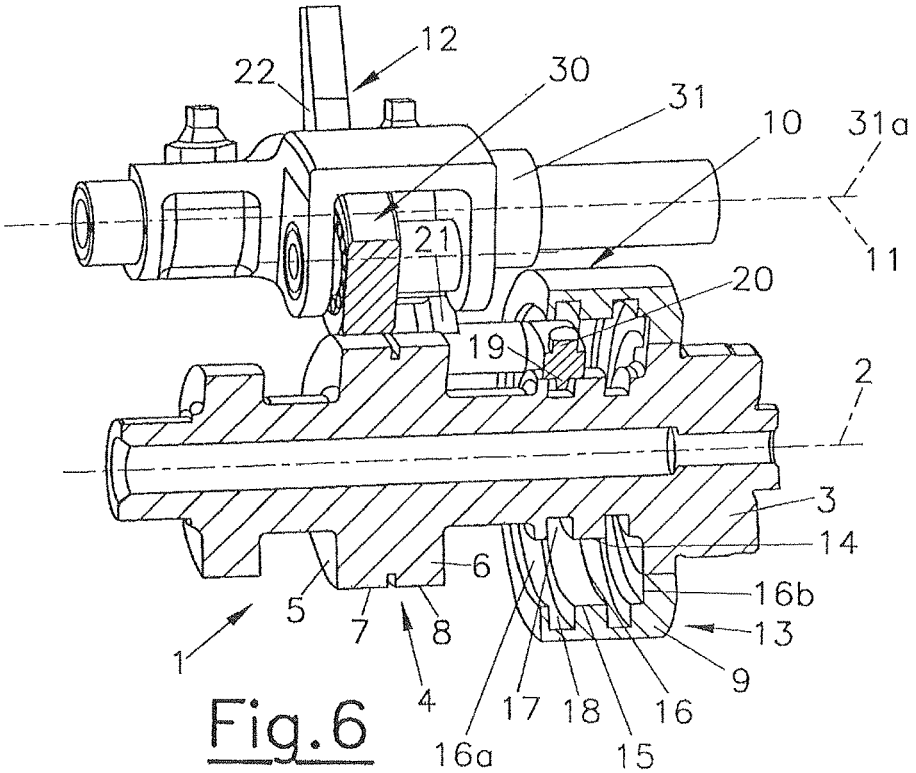
FIG. 6 shows this variable valve control device in a longitudinal section in a diagonal view in a longitudinal section in a second displacement position.
Figure 7:
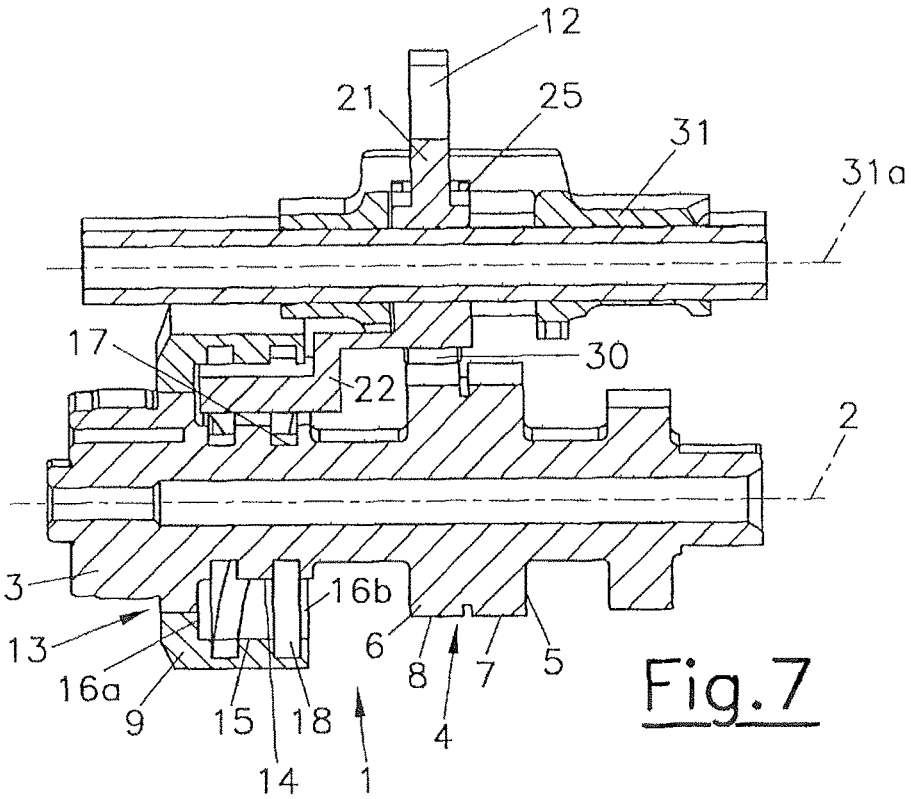
FIG. 7 shows this variable valve control device in a longitudinal section in the first displacement position.
Figure 8:
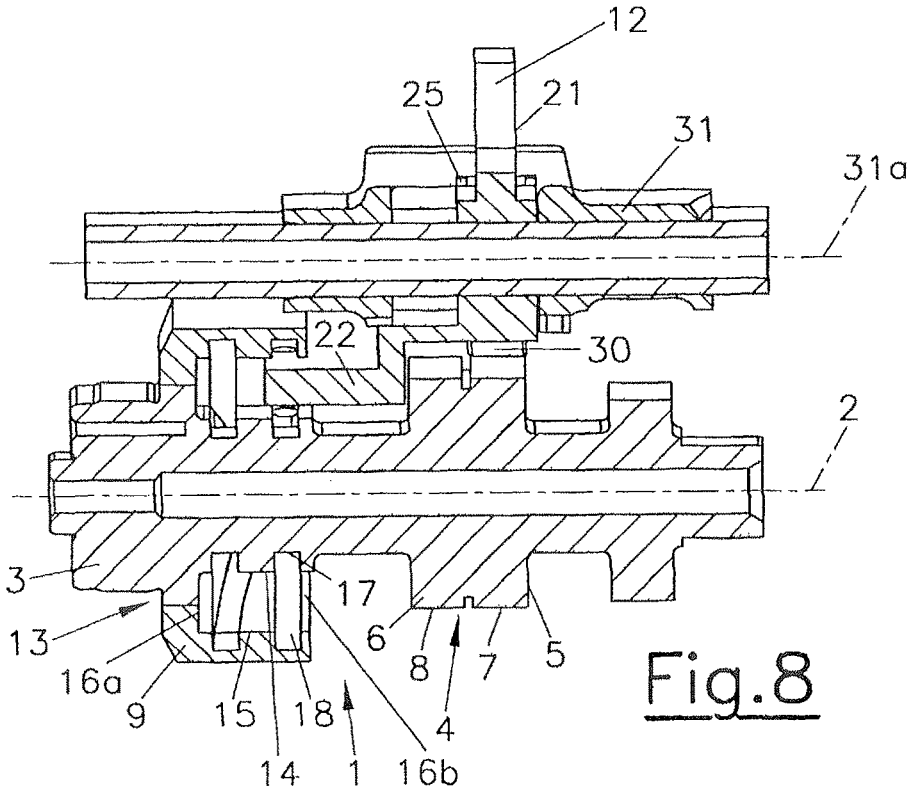
FIG. 8 shows this variable valve control device in a longitudinal section in the second displacement position.

In the first position of the control lever 12 illustrated in each case in FIG. 1 and FIG. 5, the first control stud 19 is guided out of the first control groove 17, while the second control stud 20 engages in the second control groove 18. Upon rotation of the camshaft 3 and therefore also of the control body 13, the control lever 12 is thus axially displaced in a first direction and thus causes an axial adjustment of the cam device 4 (FIG. 1 to FIG. 4) or an axial adjustment of a contacting transmission element 30 connected to the cam device 4 (FIG. 5 to FIG. 10) in this first direction. In the second position shown in each case in FIG. 2 and FIG. 6, this is reversed: the second control stud 20 is guided out of the second control groove 18, while the first control stud 19 engages in the first control groove 17. Upon rotation of the camshaft 3 and therefore also the control body 13, the control lever 12 is thus axially displaced in the direction of a second direction opposite to the first direction and thus causes, via a forked switching element 23 of the control lever 12, an axial adjustment of the cam device 4 (FIG. 1 to FIG. 4) or an axial adjustment of a contacting transmission element 30 connected to the cam device 4 (FIG. 5 to FIG. 10) in this second direction. In this case, the control lever 12 acts via a forked switching element 23 or 25 on a driver element 24 or 26, respectively, of the cam device 4 (FIG. 1 to FIG. 4) or the transmission element 30 (FIG. 5 to FIG. 10).

The time of the switchover of the control lever 12 is independent of the rotational angle of the camshaft 3, since the control grooves 17, 18 are embodied such that the adjustment procedures only take place in the region of the base circles of the cam tracks 7, 8.

To keep the driver element 24 or 26 with the forked switching element 23, 25, and also the first and second control studs 19, 20 with the first control groove 17 and second control groove 18 friction-free in the end positions, the cam element 4 or the transmission element 30 can be locked by a spring latching element 27 or 28, respectively.

In the first embodiment variant illustrated in FIG. 1 to FIG. 4, the cam device 4 is arranged in a rotationally-fixed but axially displaceable manner on the camshaft 3. The cam device 4 has in this case a driver element 24 on the side facing toward the control body 13. Due to the rotational movement of the camshaft 3 having the control grooves 17, 18, the control studs 19, 20 and thus the control lever 12 having the switching element 23 and thus the cam device 4 are axially displaced via the driver element 24 engaged with the switching element 23. The driver element 24 is formed in this case as a ring 24*a*, which is formed axially spaced apart from the cams 5, 6 in the cam device 4.

The spring latching element 27 is arranged so it is displaceable in a radial borehole of the camshaft 3 and has a latching body 27*b* loaded outward by a spring 27*a*. A first ring groove 29*a* and a second ring groove 29*b* spaced apart axially therefrom are arranged in the cam device 4 in an inner lateral surface, wherein, in the first end position of the cam device 4 shown in FIG. 1 and FIG. 3, the latching body 27*b* engages in the first ring groove 29*a*, and in the second end position of the cam device 4 illustrated in FIG. 2 and FIG. 4, the latching body 27*b* engages in the second ring groove 29*b* and thus axially locks the cam device 4 in the respective end position.

In the illustrated first exemplary embodiment, the cam device 4 acts via a transmission device 31 on the gas exchange valves (not shown in greater detail). The transmission device 31 can be designed in a conventional manner as a tilt lever or cam follower with or without roller bodies, or as a barrel tappet. In the case of a transmission element designed as a roller body, the rotatable roller body can be designed as axially non-displaceable.

In the second embodiment variant illustrated in FIG. 5 to FIG. 10, the cam device 4 is fixedly connected to the camshaft 3, for example, integrally formed therewith. The transmission device 31, which is formed, for example, by a tilt lever or cam follower rotatable about a valve lever axis 31*a*, has a transmission element 30, for example, a roller body mounted so it is rotatable on the transmission device 31 about an axis 30*a*, which is arranged so it is axially displaceable between a first position and a second position. A forked switching element 25 engages in this case on a driver element 26 of the transmission element 30. Due to the rotational movement of the camshaft 3 having the control grooves 17, 18, the control studs 19, 20 and thus the control lever 12 having the switching element 25 and therefore the transmission element 30 are axially displaced by means of the driver element 26 engaged with the switching element 25. The driver element 26 can be in this case, for example, a bearing ring of the transmission element 30 designed as a roller body.

In the illustrated second embodiment variant, the spring latching element 28 is arranged so it is radially displaceable in the transmission device 31 formed as a valve lever, specifically in a radial borehole with respect to the valve lever axis 31*a*, and has a latching body 28*b* loaded radially inward by a spring 28*a*. The control lever 12 has a first groove 12*a* in its surface facing toward the spring latching element 28 and a second groove 12 spaced apart therefrom in the direction of the valve lever axis, wherein in the first end position of the transmission element 30 shown in FIG. 9, the latching body 28*b* engages in the first groove 12*a*, and in the second end position of the transmission element 30, the latching body 28*b* engages in the second groove 12*b* and thus axially locks the transmission element 30 in the respective end position. In the illustrated second embodiment variant, the control lever 12 is mounted so it is rotatable about the valve lever axis 31*a*, the pivot axis 11 is thus coincident with the valve lever axis 31*a*.

The invention claimed is:

1. A variable valve control device for internal combustion engines of a reciprocating piston design, the variable valve control device comprising:

at least one gas exchange valve actuated by means of a camshaft rotatably mounted about a camshaft axis, a cam device connected in a rotationally-fixed manner to the camshaft, the cam device having at least two different cam tracks, wherein alternately one cam track of the at least two different cam tracks is activated and at least one other cam track of the at least two different cam tracks is deactivated by means of a control device, wherein the control device has at least one control lever pivotable about a pivot axis and at least one first control body connected in a rotationally-fixed manner to the camshaft, on the surface of the at least one first control body at least one first control groove and at least one second control groove are formed, wherein alternately a first control stud of the at least one control lever is guided into the at least one first control groove or a second control stud of the at least one control lever is guided into the at least one second control groove, wherein the at least one first control body has an inner first lateral surface and an outer second lateral surface, wherein the first lateral surface has a smaller distance from the camshaft axis than the second lateral surface and the first and second lateral surfaces are arranged concentrically to the camshaft axis, and wherein the first and second lateral surfaces face toward one another to delimit an essentially cylindrical control chamber, and the at least one first control groove is formed into the first lateral surface and the at least one second control groove is formed into the second lateral surface.

2. The valve control device according to claim 1, wherein the essentially cylindrical control chamber is embodied as open at a first end face, wherein the at least one control lever is arranged protruding through the open first end face into the control chamber.

3. The valve control device according to claim 2, wherein the first end face faces toward the cam device.

4. The valve control device according to claim 1, wherein the second lateral surface is arranged on an inner side of a sleeve part, which is fixedly connected to the camshaft.

5. The valve control device according to claim 4, wherein the sleeve part is pressed on the camshaft.

6. The valve control device according to claim 4, wherein a connection between the camshaft and the sleeve part is produced at a second end face of the control chamber facing away from the cam device.

7. The valve control device according to claim 1, wherein the pivot axis of the at least one control lever is arranged parallel to the camshaft axis.

8. The valve control device according to claim 1, wherein the pivot axis of the at least one control lever is arranged inclined to the camshaft axis, wherein, in at least one projection normal to the camshaft axis, the pivot axis encloses an angle between 0° and 60° with the camshaft axis.

9. The valve control device according to claim 1, wherein the at least one control lever has a switching element, which engages on a driver element of the cam device, the cam device arranged axially displaceable on the camshaft.

10. The valve control device according to claim 9, wherein the driver element is formed by a ring axially spaced apart from the at least two different cam tracks.

11. The valve control device according to claim 10, wherein the ring is arranged at an end of the cam device facing toward the at least one first control body.

12. The valve control device according to claim 9, wherein the switching element is forked.

13. The valve control device according to claim 1, wherein the at least one control lever has a switching element which engages at a transmission element actuated by the cam device connected in a non-displaceable manner to the camshaft, the transmission element is formed so as to be displaceable parallel to the camshaft axis.

14. The valve control device according to claim 13, wherein the transmission element is a roller body which is rotatable and axially displaceable on a valve lever.

15. The valve control device according to claim 13, wherein the switching element is forked.

16. The valve control device according to claim 13, wherein the cam device is integrally formed with the camshaft.

17. The valve control device according to claim 1, wherein the cam device or the transmission element is lockable via at least one spring latching element.

* * * * *